US005865224A

United States Patent [19]

Ally et al.

[11] Patent Number: 5,865,224

[45] Date of Patent: Feb. 2, 1999

[54] METHOD AND APPARATUS FOR AUTOMATED DISPENSING

[75] Inventors: Abdul H. Ally, Gaithersburg, Md.; Michael W. Schuette, Vienna, Va.

[73] Assignee: Life Technologies, Inc., Rockville, Md.

[21] Appl. No.: 770,502

[22] Filed: Dec. 20, 1996

[51] Int. Cl.[6] ..... B65B 1/04; B65B 3/04

[52] U.S. Cl. ..... 141/130; 141/192; 141/237

[58] Field of Search ..... 141/130, 1, 98, 141/153, 178, 183, 188, 192, 196, 234, 237, 238; 222/61, 63, 639, 641; 422/67; 436/54, 50

[56] References Cited

U.S. PATENT DOCUMENTS

| | | | |
|---|---|---|---|
| 3,261,208 | 7/1966 | Fisher . | |
| 3,536,449 | 10/1970 | Astle . | |
| 3,732,903 | 5/1973 | Oates . | |
| 4,085,780 | 4/1978 | Holley . | |
| 4,417,610 | 11/1983 | Waldström et al. . | |
| 4,450,981 | 5/1984 | Haig . | |
| 4,548,245 | 10/1985 | Crandell et al. . | |
| 4,593,728 | 6/1986 | Whitehead et al. . | |
| 4,675,163 | 6/1987 | Mybeck . | |
| 4,995,432 | 2/1991 | Tervamäki et al. . | |
| 5,012,957 | 5/1991 | Mihail . | |
| 5,040,106 | 8/1991 | Maag | 222/639 |
| 5,046,539 | 9/1991 | MacLeish et al. . | |
| 5,090,594 | 2/1992 | Randall, Jr. et al. . | |
| 5,105,859 | 4/1992 | Bennett et al. . | |
| 5,145,092 | 9/1992 | Shannon . | |
| 5,188,258 | 2/1993 | Iwashita . | |
| 5,267,590 | 12/1993 | Pringle . | |
| 5,305,809 | 4/1994 | Pringle . | |
| 5,454,406 | 10/1995 | Rejret et al. | 222/641 |
| 5,472,672 | 12/1995 | Brennan . | |
| 5,496,473 | 3/1996 | Chow . | |
| 5,522,439 | 6/1996 | Håkansson et al. . | |
| 5,529,756 | 6/1996 | Brennan . | |

*Primary Examiner*—Steven O. Douglas
*Attorney, Agent, or Firm*—Sterne, Kessler, Goldstein & Fox, P.L.L.C.

[57] ABSTRACT

An automated dispensing device is provided that dispenses a calibrated quantity of a fluid into a receptacle having a plurality of spaced-apart rows of receiving wells. The calibrated quantity of fluid is determined based upon a dispensing time and a dispensing scale factor that accounts for the viscosity of the fluid to be dispensed. The automated dispensing device can be configured with independently controllable nozzles for selective delivery of fluid. The automated dispensing device is particularly suitable for dispensing a calibrated quantity of ammonium hydroxide into the receiving wells of each row of a microtiter plate for oligonucleotide cleavage.

32 Claims, 11 Drawing Sheets

METHOD AND APPARATUS FOR AUTOMATED DISPENSING

BACKGROUND OF THE INVENTION

1. Field of the Invention

The present invention is directed to a method and apparatus for automated dispensing. More particularly, the present invention is directed to an automated dispensing system that dispenses a predetermined and precise amount of fluid into the wells of a multi-welled dish of the type usually employed for carrying out immunoassay and biochemical reactions.

2. Related Art

In many chemical and biochemical reactions and processes, it is necessary to distribute reagent or solution precisely and rapidly to multiple containers. One such process is the synthesis of oligonucleotides. Oligonucleotides play increasing and critical roles in diagnostic medicine, forensic medicine, and molecular biology research. In a conventional oligonucleotide synthesis process by phosphoramidite coupling, bases are sequentially coupled to a solid support. For example, the first nucleoside, protected at the 5' position, is derivatized to a solid support, usually controlled pore glass. The sugar group of the first nucleoside is deprotected or detritylated using an appropriate reagent to produce a colored product that may be monitored for reaction progress. The second nucleotide, that has the phosphorous, sugar and base groups protected, is added to the growing chain, usually in the presence of a tetrazole catalyst. The unreacted first nucleoside is capped to avoid perpetuating errors, using reagents such as acetic anhydride and N-methylimidazole. The phosphite triester is oxidized to form the more stable phosphate triester, usually using an iodine reagent. This process is repeated as needed to produce the desired length and sequence of the oligonucleotide. At the conclusion of the synthesis, the cleavage from the solid support is done, usually using aqueous ammonia. The oligonucleotides are then deprotected and dried to remove the ammonia solution. The oligonucleotides can then be resuspended in water, and quantitated using vertical spectrophotometry.

An apparatus and method for synthesizing an array of oligonucleotides is disclosed in U.S. Pat. Nos. 5,472,672 and 5,529,756. The foregoing two patents describe a synthesis apparatus that can be used to synthesize 96 oligonucleotides at one time using a standard microtiter well spacing format (8×12 array). The synthesis apparatus includes a delivery assembly for controlling delivery of the liquid reagents required in the synthesis process through an array of nozzles. A transport mechanism is provided so that the array of wells in the microtiter plate can be aligned with the array of nozzles in the delivery assembly. The delivery assembly is part of a head assembly that is coupled to a base assembly that includes the microtiter plate. A sliding seal is located between the bottom surface of the head assembly and the top surface of the base assembly to environmentally contain both the reactions wells and the nozzles in a common chamber. The sliding seal is used to exclude water and oxygen from the common reaction chamber during synthesis. Phosphoramidites are sensitive to hydrolysis by tracing of water, and to oxidation by contact with air. Because the coupling reactions are rapid and irreversible, it is necessary to exclude both water and oxygen from the reaction chamber during synthesis.

The apparatus described in U.S. Pat. Nos. 5,472,672 and 5,529,756 can be used to synthesize oligonucleotides in the reaction wells of a synthesis plate. Once synthesis is complete, the synthesis plate is removed from the apparatus and stacked on top of a second 96-well deprotection plate for the oligonucleotide cleavage step. The cleavage step requires pipetting 200 microliters of concentrated $NH_4OH$ (ammonium hydroxide) into each well of the synthesis plate. The cleavage step is repeated twice with fresh aliquots of ammonia.

The cleavage step of pipetting concentrated $NH_4OH$ into each well of the synthesis plate can be carried out by manually pipetting the appropriate aliquot into each well since the cleavage step does not require a controlled environment such as in the reaction chamber of the synthesis apparatus described above. Alternatively, the pipetting step could be carried out using an automated pipetting device, such as the automatic fluid dispenser for a multi-welled dish disclosed in U.S. Pat. No. 5,046,539. The fluid dispenser in this patent uses a single pipette. The multi-welled dish is moved using stepper motors in two directions to correspond to the two-dimensional array of rows and columns of the multi-welled dish. A stepper motor is also used to bias a plunger to force air, or other gas under pressure, into the single pipette. In order to deposit a precise amount of fluid in each well, the stepper motor is calibrated to control the amount of force exerted by the plunger.

The fluid dispenser disclosed in U.S. Pat. No. 5,046,539 has numerous drawbacks. Only a single pipette is used in the fluid dispenser to simplify sterilization procedures. However, because only a single pipette is used, the fluid dispenser must be configured for two-dimensional movement so that all of the wells in the multi-welled dish can be filled. The fluid dispenser fills the wells one at a time with the single pipette, offering little time savings over manually pipetting into the wells one at a time. Additionally, the fluid dispenser does not provide an accurate means for dispensing a calibrated amount of fluid. Controlling the force of the plunger by calibrating a stepper motor does not provide an accurate calibration, particularly for fluids of varying viscosity.

The fluid dispenser disclosed in U.S. Pat. No. 5,046,539 has a further drawback in that it cannot accurately dispense ammonium hydroxide. Ammonium hydroxide is very volatile at room temperature. Therefore, at room temperature, ammonium hydroxide expands continually. This results in continual loss of fluid from the end of the pipette.

A syringe pump is conventionally used to pump reagents in chemical and biochemical processes. However, syringe pumps are susceptible to leakage when volatile fluids are used. A volatile fluid will expand, causing a "blow-by" condition whereby the gas comes out of solution, and leaks out between the pump piston and the seal. Syringe pumps are typically configured with a long nozzle that terminates at a delivery end. When such a syringe pump is used to pump a volatile fluid such as $NH_4OH$, the volatile fluid will keep dribbling out of the delivery end. Consequently, a syringe pump must be configured with a valve at the delivery end of the nozzle in order to reliably and accurately dispense volatile fluids. To deliver a calibrated quantity of a volatile fluid with a conventional syringe pump, both the pump and a valve on the delivery end of the nozzle must be controlled.

Therefore, there is a need in the art for a device that can dispense a calibrated quantity of fluid simultaneously into a plurality of wells. Particularly, there is a need in the art for a device that can dispense a calibrated quantity of ammonium hydroxide simultaneously into a plurality of wells in a microtiter plate for oligonucleotide cleavage. There is a further need for a device that can dispense a calibrated quantity of volatile fluids, as well as fluids of varying viscosities.

SUMMARY OF THE INVENTION

The present invention is directed to a method and apparatus for automated dispensing. In one aspect of the invention, an apparatus is provided that dispenses a calibrated quantity of a fluid into a receptacle that has an array of spaced-apart receiving wells arranged in well rows. The apparatus includes an array of nozzles through which the fluid flows into the receiving wells. The nozzles in the array are spaced-apart by a distance substantially similar to the spacing between receiving wells in the well row. This provides for alignment between the array of nozzles and the receiving wells in the well row. Relative movement means provide relative movement between the receptacle and the array of nozzles. The relative movement means provides movement to a dispensing position where the well row is aligned with the array of nozzles. The apparatus also includes a dispensing control means for dispensing a dispensing volume into the receiving wells. The dispensing control means is operatively coupled to the array of nozzles to cause fluid to flow from each nozzle in the array. The fluid flows for a time period equal to a dispensing time. The dispensing control means determines the dispensing time from the dispensing volume and a dispensing scale factor. The dispensing scale factor is the time required to dispense a unit volume of the fluid. In this manner, the apparatus of the present invention can dispense a calibrated quantity of different fluids having varying viscosities.

The apparatus of the present invention can also include a moving control means that is operatively coupled to the relative movement means and to the dispensing control means. The moving control means controls movement of the relative movement means. In one aspect of the present invention, the relative movement means comprises a movable platform and the moving control means comprises a servo controller.

The apparatus of the present invention can also include a nozzle control means that is operatively coupled to the dispensing control means. The nozzle control means controls flow of the fluid through the array of nozzles. In one aspect of the present invention, the nozzle control means comprises a solenoid operated valve.

In another aspect of the present invention, a method is provided for dispensing a calibrated quantity of a fluid into one or more receptacles, each receptacle having an array of spaced-apart receiving wells arranged in a plurality of spaced-apart well rows. The method comprises the following steps: determining a number of dispensing positions, each dispensing position corresponding to a corresponding well row in the array; determining a dispensing volume to be dispensed at each dispensing position; determining a dispensing scale factor, the dispensing scale factor being the time required to dispense a unit volume of the fluid; determining a dispensing time from the dispensing volume and the dispensing scale factor; and, at each of the dispensing positions, allowing the fluid to flow into the receiving wells of the corresponding well row for a time period equal to the dispensing time.

In yet a further aspect of the present invention, the method includes sequentially moving the array to each of the dispensing positions so that the corresponding well row is aligned with an array of nozzles for dispensing the dispensing volume into the receiving wells of the corresponding well row.

In a still further aspect of the present invention, an apparatus for dispensing a calibrated quantity of a fluid is provided. The apparatus includes a nozzle through which the fluid flows. Pressurizing means pressurize the fluid, making it particularly suitable for use with volatile fluids. Dispensing control means are operatively coupled to the nozzle for dispensing a dispensing volume of the fluid. The dispensing control means causes fluid to from the nozzle for a time period equal to a dispensing time. The dispensing control means determines the dispensing time from the dispensing volume and a dispensing scale factor. The dispensing scale factor is the time required to dispense a unit volume of the fluid. In this manner, the apparatus of the present invention can dispense a calibrated quantity of different fluids having varying viscosities.

In a still further aspect of the present invention, an apparatus for selectively dispensing fluid in a receptacle having an array of spaced-apart receiving wells is provided. The apparatus includes an array of nozzles through which the fluid flows into the receiving wells. The apparatus also includes a dispensing control means operatively coupled to the array of nozzles to independently control dispensing by each of the nozzles in the array. The dispensing control means dispenses a dispensing volume from one of the nozzles by causing fluid to flow from the nozzle for a time period equal to a dispensing time. The dispensing control means determines the dispensing time from the dispensing volume and a dispensing scale factor. The dispensing scale factor is the time required to dispense a unit volume of the fluid. This aspect of the present invention is particularly advantageous in that the nozzles can be individually opened and closed, and the nozzles can be configured to dispense the same, or different, types of fluid. The dispensing control means can include determining means for determining one or more of the following: a receiving well identifier that identifies each of the spaced-apart receiving wells to receive fluid; a dispensing position location for each receiving well identifier; a nozzle identifier that identifies one of the nozzles for each receiving well identifier; and a dispensing volume for each receiving well identifier.

In yet a further aspect of the present invention, a computer program product is provided that includes computer program logic for enabling a processor in a computer system to carry out the method of the present invention.

Features and Advantages

It is a feature of the present invention that it dispenses a calibrated quantity of fluid. It is a further feature of the present invention that this calibration is done by dispensing fluid for a dispensing time period that is a function of the viscosity of the fluid.

It is a further feature of the present invention that it dispenses fluid substantially simultaneously into the receiving wells in a well row of a receptacle.

It is yet a further feature of the present invention that it can be configured to accurately dispense a calibrated quantity of volatile fluids, as well as fluids having varying viscosities.

It is still a further feature of the present invention that it can be configured to dispense a calibrated quantity of fluid into receptacles having a variety of configurations.

A still further feature of the present invention is that the nozzles are independently controllable on an individual basis for selective delivery of fluid. The nozzles can be individually opened and closed. The nozzles can be configured to dispense the same, or different, types of fluid.

It is an advantage of the present invention that it replaces manual pipetting conventionally used for the oligonucleotide cleavage step.

It is an advantage of the present invention that it can be used to dispense a calibrated quantity of volatile fluids, as well as fluids having varying viscosities.

It is a further advantage of the present invention that it can be easily configured to quickly dispense a calibrated quantity of ammonium hydroxide into a plurality of 96-well microtiter plates for oligonucleotide cleavage.

It is a further advantage of the present invention that it provides for a cost effective device that can be easily configured to dispense fluid into a plurality of chambers simultaneously.

A further advantage of the present invention is that it can be configured for selective delivery of fluids using independently controllable nozzles.

The present invention is also advantageous in that only one direction of movement is required to rapidly dispense fluid into a two-dimensional array of receiving wells.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Overview

Figure 1:
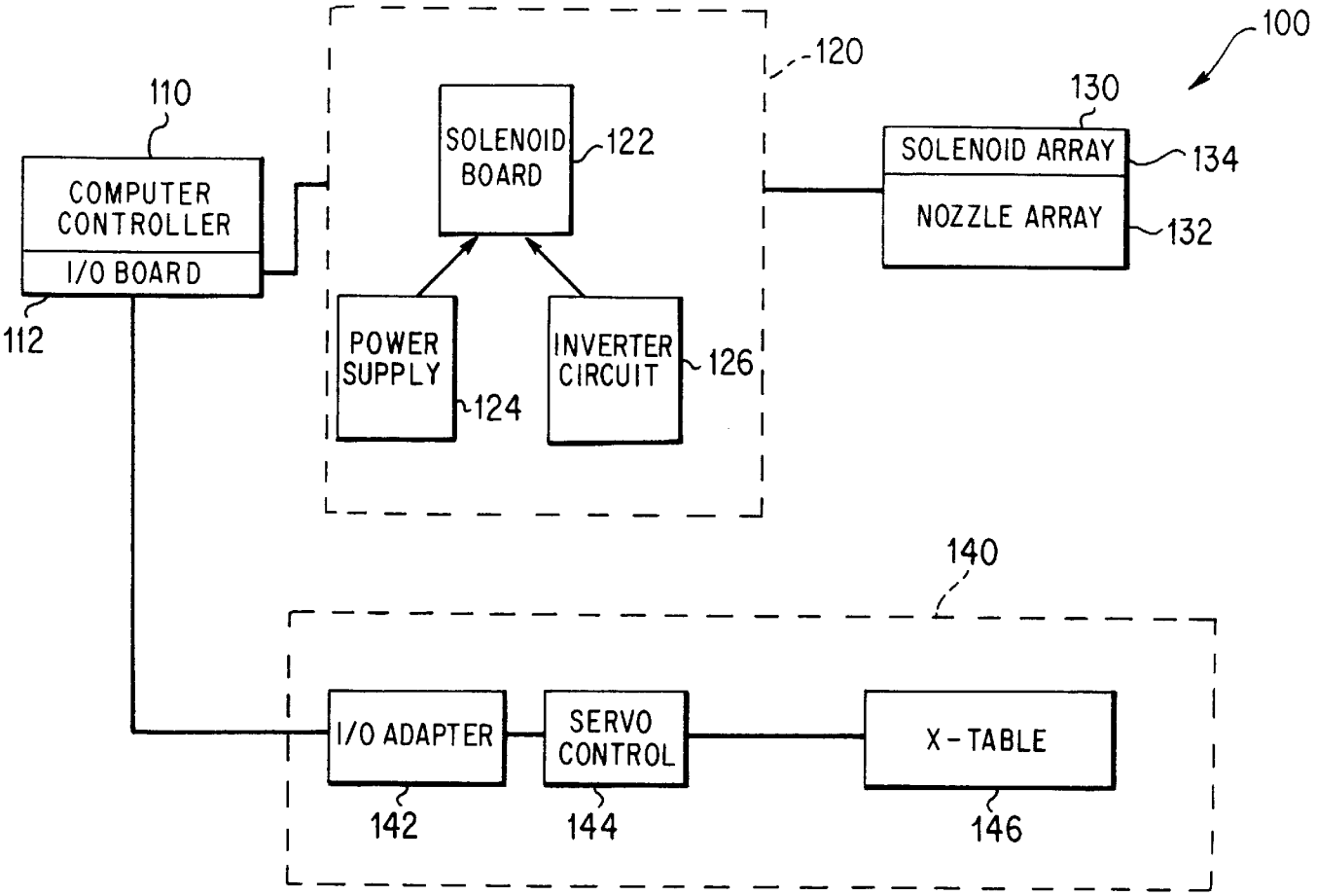
FIG. 1 shows a block diagram illustrating one embodiment of the automated dispensing system of the present invention.

The present invention is directed to an automated dispensing system that dispenses a calibrated quantity of fluid into one or more receiving wells. The accuracy of the quantity of fluid dispensed by the present invention is achieved by using time, and a dispensing scale factor that is a function of the viscosity of the fluid, as parameters that control the quantity of fluid dispensed.

The automated dispensing system of the present invention is particularly useful for dispensing ammonium hydroxide ($NH_4OH$) into 96-well microtiter plates for oligonucleotide cleavage. The automated dispensing system of the present invention replaces manual pipetting conventionally used for the oligonucleotide cleavage step. In contrast to other devices, the automated system of the present invention can be configured to simultaneously and accurately dispense the $NH_4OH$ into all wells in a row of a microtiter plate. In such a configuration, the automated dispensing system of the present invention includes an array of dispensing nozzles controlled by an array of solenoid valves, with one solenoid valve per dispensing nozzle. As used herein, "array" refers to two or more nozzles, valves, receiving wells, etc. In a configuration for use with a microtiter plate, the dispensing nozzle array would preferably include twelve dispensing nozzles, and the solenoid valve array would preferably include twelve solenoid valves. The dispensing nozzles are arranged in a single row, at a spacing of approximately 9 mm between dispensing nozzles to correspond to the 9 mm spacing of the receiving wells of a microtiter plate.

The array of dispensing nozzles is positioned over a movable platform carrying one or more 96-well microtiter synthesis plates. A servo driven linear slide is used to move the platform so that the array of dispensing nozzles is sequentially aligned with the rows of wells in the microtiter plates. A pressurized supply of $NH_4OH$ is used, with a supply tube running from the pressurized supply to each solenoid valve. When the solenoid valves are actuated, the pressure in the bottle forces the $NH_4OH$ through the supply tubes and out through the dispensing nozzles until the solenoid valves are closed. A computer controller is used for control of the linear slide and the solenoid valves. With the automated dispensing system of the present invention, less than one minute is required to dispense liquid into four microtiter plates, filling a total of 384 wells.

The automated dispensing system of the present invention can be configured so that each of the solenoid valves is independently controllable on an individual basis. In this manner, each dispensing nozzle can be independently controlled for selective delivery of fluid. This configuration allows more than one type of fluid (for example, different reagents) to be dispensed into the receiving wells. Each dispensing nozzle can be configured to dispense the same, or a different, type of fluid as the other dispensing nozzles in the array. This configuration also allows individual dispensing nozzles to remain closed, so that no reagent is dispensed.

System Description

FIG. 1 shows a block diagram that illustrates one embodiment of an automated dispensing system 100 of the present invention. System 100 includes a computer controller 110. Computer controller 110 functions as a dispensing control means for the present invention. As shown in FIG. 1, computer controller 110 includes an input/output (I/O) board 112. By "I/O board" is meant any interface that provides input to and output from computer controller 110 of signals (digital, analog, radio frequency, etc.). It should be understood that the form of I/O board 112 is not limited to a printed circuit card or board, and can be of any form suitable for performing the interface function. I/O board 112 provides signal input and output to computer controller 110. A particularly preferred I/O board 112 is a PCL-720 digital I/O and counter card available from ADVANTECH, located in California. The PCL-720 card includes 32 digital input channels, 32 digital output channels, and 3 programmable counter/timer channels.

Computer controller 110 is communicatively and operatively coupled to a power supply and junction box 120 via I/O board 112. Power supply and junction box 120 includes a solenoid board 122, a power supply 124, and an inverter circuit 126. Each of the foregoing components of power supply and junction box 120 will be described in more detail below with reference to FIGS. 4 and 5. Power supply and junction box 120 is coupled to a dispenser 130. Dispenser 130 includes a nozzle array 132 controlled by a solenoid array 134.

Computer controller 110 is communicatively and operatively coupled to a linear translation system 140 via I/O board 112. Linear translation system 140 functions as a means for providing relative movement between dispenser 130, particularly nozzle array 132, and the receiving wells. Linear translation system 140 enables nozzle array 132 to be appropriately aligned with the receiving wells, for example, the receiving wells in a microtiter plate. In the embodiment detailed below, linear translation system 140 moves a platform containing the receiving wells, while nozzle array 132 remains stationary. It is to be understood that the present invention is not limited to such an embodiment of linear translation system 140. In an alternate embodiment of the present invention, linear translation system 140 is configured so that nozzle array 132 is moved while the receiving wells remain stationary. In yet a further embodiment of the present invention, linear translation system 140 is configured so that both nozzle array 132 and the receiving wells are moved. It would be readily apparent to one of skill in the relevant arts how to configure such alternate embodiments of linear translation system 140.

Linear translation system 140 includes an I/O adapter 142, a servo controller 144, and an X-table 146. I/O adapter 142 functions as a control interface between computer controller 110 and servo controller 144. Servo controller 144 provides the signals required to move X-table 146. I/O adapter 142 receives a command from computer controller 110 via a connection 243 (shown in FIG. 2) for X-table 146 to move to a particular location or to move a specified distance. I/O adapter 142 converts the command received from computer controller 110 into the appropriate command for servo controller 144. Servo controller 144 sends the appropriate signal to X-table 146 via a connection 247 (shown in FIG. 2) to move to the particular location or the specified distance.

As used herein, "X-table" refers to a moveable table or platform that can be controlled to move in at least one direction. Such a device is also known as a "linear slide." It should be understood that the present invention is not limited to the use of a uni-directional or one dimensional X-table, and the present invention can be carried out using a table or platform moveable in two or three dimensions. A particularly preferred X-table is model SA A5M400 available from IAI America, Inc., Torrance, Calif. The IAI linear slide is powered by 24 volts and includes a servo control and an I/O adapter. The I/O adapter for the IAI linear slide provides an I/O interface between an RS-232C serial interface input from a computer, and the servo control (S-SEL Controller, Serial Communication Protocol).

Figure 2:
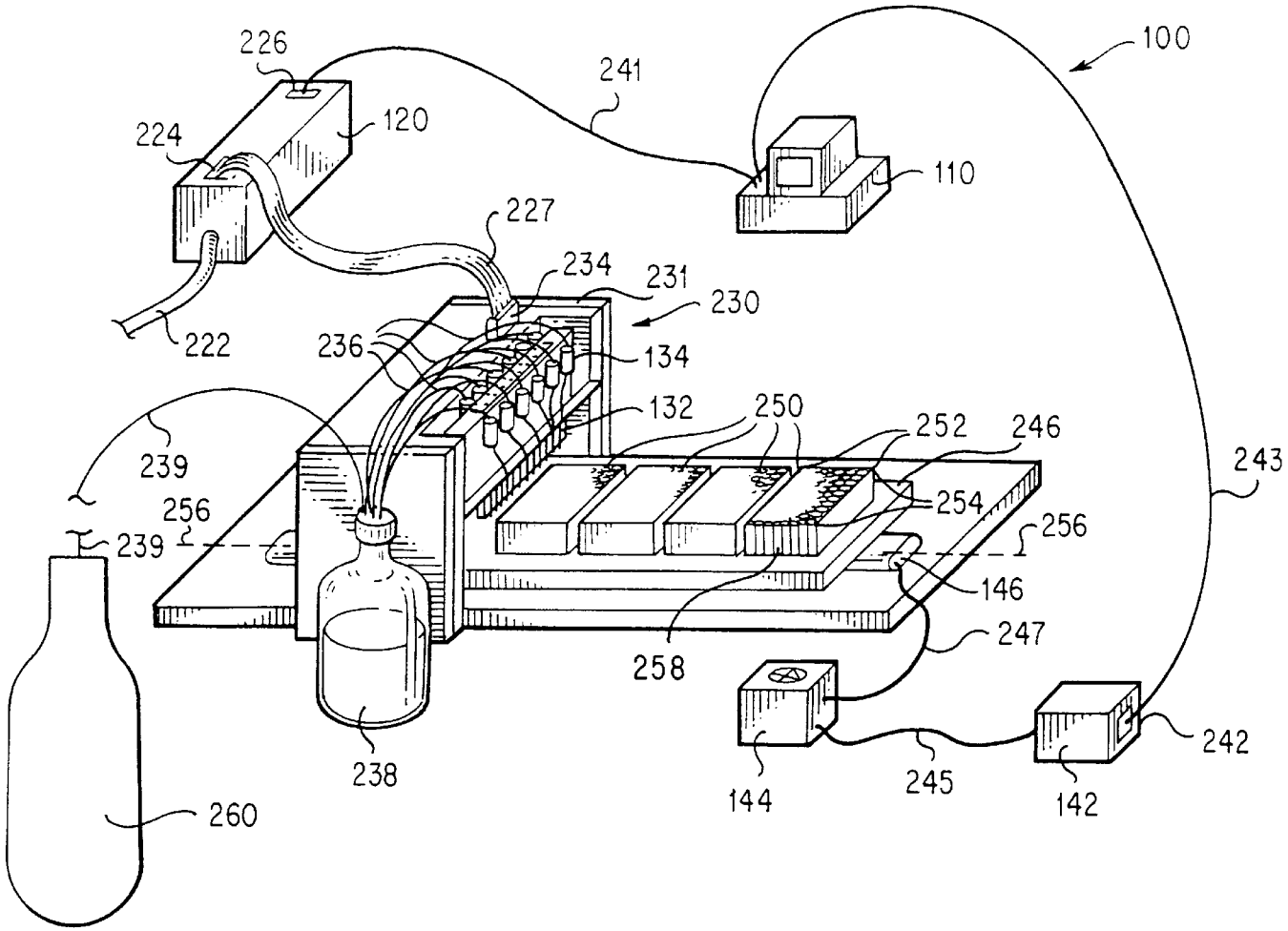
FIG. 2 shows a perspective view of one embodiment of the automated dispensing system of the present invention.

With reference now to FIG. 2, automated dispensing system 100 is shown in more detail. As shown in FIG. 2, power supply and junction box 120 is coupled to computer controller 110 via a connection 241 that connects to a connector 226. Connector 226 provides a communication channel connection between I/O board 112 in computer controller 110 and solenoid board 122 in power supply and junction box 120.

A connection is provided between power supply and junction box 120 and solenoid array 134 via a ribbon cable 227. Ribbon cable 227 terminates at solenoid array 134 at a connector 234, and at the circuitry end at a connector 224 in power supply and junction box 120. A line voltage input 222 is provided to power the components in power supply and junction box 120.

Computer controller 110 is coupled via connection 243 to I/O adapter 142 that connects to a connector 242. Connector 242 provides a communication channel connection between I/O board 112 in computer controller 110 and I/O adapter 142. I/O adapter 142 is coupled to servo controller 144 via a connection 245. Servo controller 144 is coupled to X-table 146 via connection 247.

A platform 246 is disposed on X-table 146. Platform 246 is configured to hold or carry one or more receptacles 250. In a preferred embodiment, platform 246 is configured to hold four receptacles 250. It is to be understood that platform 246 can be configured to carry other numbers of receptacles 250 other than the four as illustrated in FIG. 2. Platform 246 can also be configured with trays designed to hold tubes, vials, and microplate assemblies of varying configurations. In a particularly preferred embodiment, receptacle 250 is configured as a 96-well microtiter plate. Such a microtiter plate includes an array of 96 spaced-apart receiving wells 258 arranged in an 8×12 array. The 8×12 array includes eight equally spaced well rows 252, each well row 252 extending transverse or perpendicular to a longitudinal axis 256 of X-table 146, and twelve equally spaced-apart well columns 254 parallel to longitudinal axis 256. Such a microtiter plate is preferably fabricated from a chemically inert material such as polypropylene. It is to be understood that any number of receiving wells, or arrangement of rows and columns in receptacle 250, can be employed in the present invention.

A dispenser assembly 230 is used to dispense a calibrated quantity of fluid into each of receptacles 250. In one embodiment, dispenser assembly 230 is formed in a dispenser block 231 which can be made from a readily fabricable acrylic material such as LUCITE®. LUCITE® is a registered trademark of E.I. duPont de Nemours and Company. Solenoid array 134 and nozzle array 132 are coupled to dispenser block 231. The fluid to be dispensed is transferred to nozzle array 132 from a fluid supply 238 via tubing 236. In a preferred embodiment, fluid supply 238 contains ammonium hydroxide ($NH_4OH$) suitable for oligonucleotide cleavage. Fluid supply 238 is pressurized via a pressurizing means 260 connected to fluid supply 238 via a line 239. Pressurizing means 260 is preferably a 5 psi $N_2$ (nitrogen) supply.

Pressurization of fluid supply 238 by pressurizing means 260 serves two purposes. The pressure forces the fluid to flow from fluid supply 238 through tubing 236, and out through nozzles 332. This eliminates the need for a separate pumping device. Additionally, pressurizing fluid supply 238 keeps volatile fluids, such as $NH_4OH$, in solution. Pressurizing means 260 enables the present invention to be used with volatile fluids, such as $NH_4OH$.

More than one fluid supply 238 can be used. For example, multiple reagent bottles can be used for fluid supply 238. As an example, three reagent bottles each containing $NH_4OH$ can be used, each reagent bottle having four delivery lines (tubing 236) to provide $NH_4OH$ to a total of twelve nozzles.

Figure 3A:
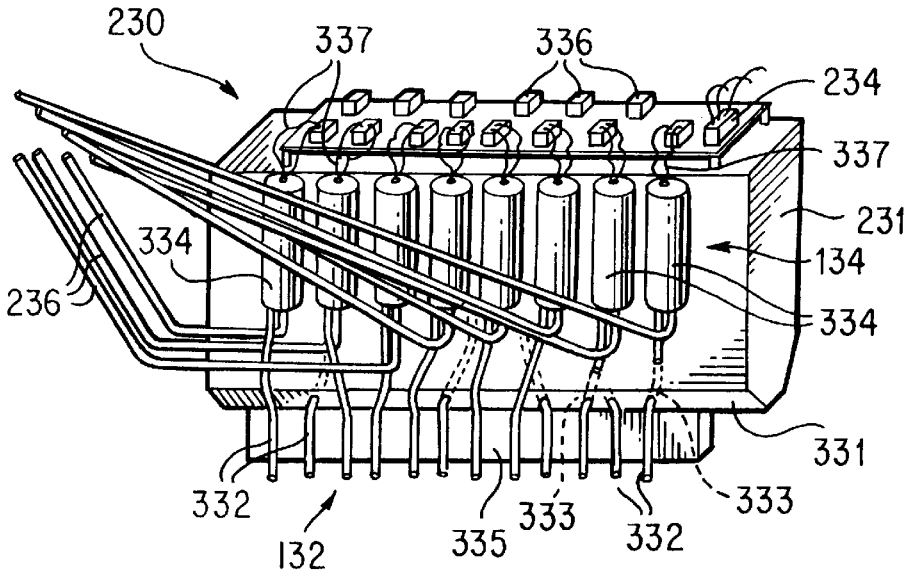
FIGS. 3A, 3B, and 3C show further detail for a dispenser assembly shown in FIG. 2.
Figure 3B:
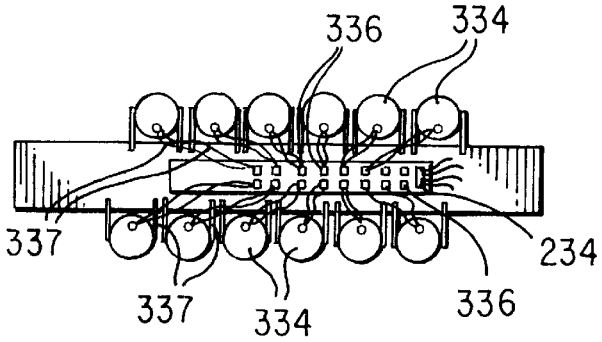
Figure 3C:
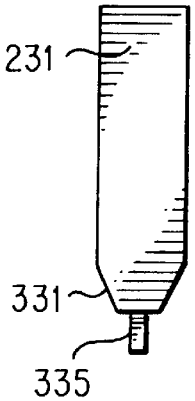

Dispenser assembly 230 is shown in more detail in FIGS. 3A, 3B, and 3C. As shown in FIG. 3A, nozzle array 132 includes a plurality of individual nozzles 332. Twelve (12) nozzles 332 are shown in FIG. 3A for nozzle array 132. It is to be understood that other numbers of individual nozzles 332 can be used in nozzle array 132. In a particularly preferred embodiment, nozzles 332 in nozzle array 132 are spaced apart by a distance that is substantially similar to the spacing between receiving wells in receptacle 250. When receptacle 250 is a 96-well microtiter plate, the spacing between nozzles 332 in nozzle array 132 is approximately 9 mm (center to center). In this manner, nozzles 332 in nozzle array 132 can be aligned with receiving wells 258 in each row 252 of receptacle 250. The spacing between nozzles 332 can be varied to match the configuration or format of the receptacles into which fluid is to be dispensed.

Nozzles 332 exit from dispenser block 231 through holes 333 formed in a tapered portion 331 and a nozzle guide 335 of block 231. Nozzle guide 335 ensures alignment with receiving wells 258. Nozzle guide 335 is also preferably made from an acrylic material, such as LUCITE®, and can depend from dispenser block 231 or can be made integral therewith. Alternatively, dispenser block 231 can be formed without nozzle guide 335 so that nozzles 332 exit from tapered portion 331.

Solenoid array 143 includes a plurality of individual solenoids 334. As best seen in FIG. 3B, twelve (12) solenoids 334 are used for solenoid array 134. Twelve solenoids 334 are used in solenoid array 134 so that one solenoid 334 corresponds to each of nozzles 332 in nozzle array 132. It is to be understood that other numbers of solenoids 334 could be used in solenoid array 134, and that arrangements other than a one-to-one correspondence between solenoids 334 and nozzles 332 can be used. A solenoid terminal 336 is provided for each solenoid 334. Solenoid leads 337 connect solenoid 334 to its respective solenoid terminal 336 (two solenoid leads 337 per solenoid). The two solenoid leads 337 for each solenoid 334 are connected to pins in connector 234.

Each solenoid 334 is used to control the flow of fluid through nozzles 332. In one embodiment, a solenoid operated valve (not shown) is used to allow fluid from fluid supply 238 to flow through nozzle 332 into receiving well 258. One side of each solenoid operated valve is connected to supply tubing 236 which provides fluid from fluid supply 238. In the embodiment shown in FIG. 3A, one tube 236 is provided for each solenoid actuated valve. The other end of the solenoid actuated valve is connected to nozzle 332. Preferably, a normally closed valve is used so that when each solenoid 334 is deactivated, its associated solenoid actuated valve is closed. Likewise, when each solenoid 334 is activated, the associated solenoid actuated valve is opened. Such valves are available from Lee Valve Company located in Connecticut, particularly the LFVA series of valves. It is to be understood that the present invention is not limited to the use of solenoids and solenoid operated valves for controlling flow of the fluid through nozzle array 132. Other nozzle control means can be used for controlling flow of the fluid through nozzle array 132.

Figure 4:
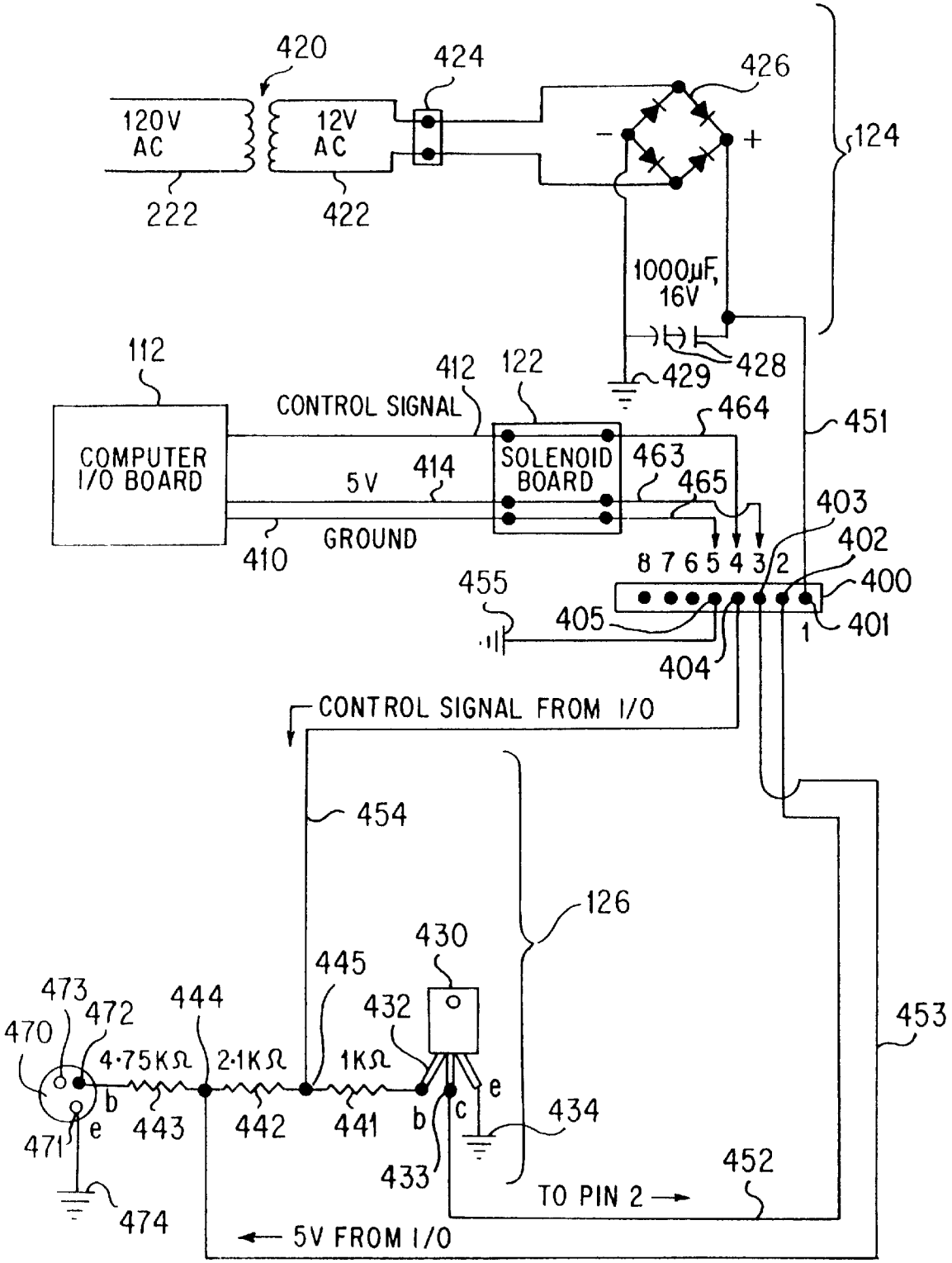
FIG. 4 shows one embodiment of a schematic for implementation of the present invention.

With reference now to FIG. 4, one embodiment of a schematic for implementation of the present invention is shown. FIG. 4 provides detail of one embodiment for connection of I/O board 112 to solenoid board 122, power supply 124 and inverter circuit 126 of power supply and junction box 120. Three signal lines are output from I/O board 112. A ground line 410 is output from I/O board 112 and connected to solenoid board 122. Ground line 410 is output from solenoid board 122 as ground line 465 that is connected to an eight pin connector 400 at pin 5 (shown at 405), and grounded at a ground 455. Connector 400 provides a connection point for the signals being sent between solenoid board 122, power supply 124, inverter circuit 126, and I/O board 112.

A 5 Volt (V) line 414 is output from I/O board 112 and connected to solenoid board 122. 5 V line 414 is output from solenoid board 122 as 5 V line 463 that is connected to connector 400 at pin 3 (shown at 403).

A control signal line 412 is output from I/O board 112 and connected to solenoid board 122. Control signal line 412 is output from solenoid board 122 as control signal line 464 that is connected to connector 400 at pin 4 (shown at 404).

Power supply 124 includes a transformer 420, with 120 V AC line voltage input 222 and a 12 V AC output 422. Output 422 is connected to a 4 amp bridge rectifier 426 via a connector 424. The two sides of bridge rectifier 426 are connected by two 100 $\mu$F capacitors 428, and grounded at a ground 429. An output 451 of power supply 124 is connected to connector 400 at pin 1 (shown at 401).

Inverter circuit 126 is used to invert control signal 412 from I/O board 112 for actuating the solenoids. Control signal 412 is a normally high control line. Control signal 412 is input to inverter circuit 126 as a control signal line 454. Control signal line 454 connects to inverter circuit 126 at a tap point 445 and to connector 400 at pin 4 shown at 404. The control signal is inverted in inverter circuit 126, and is output from inverter circuit 126 on a control signal line 452 that connects to pin 2 of connector 400 (shown at 402).

Inverter circuit 126 includes a Darlington transistor 430 that has an emitter 431 connected to a ground 434, a base 432, and a collector 433. Inverter circuit 126 also includes an NPN transistor 470 that includes an emitter 471 connected to a ground 474, a base 472, and a collector 473. Base 432 of Darlington transistor 430 is connected to base 472 of NPN transistor 470 through a resistor 441 (1 kOhm), a resistor 442 (2.1 kOhm), and a resistor 443 (4.75 kOhm). Control signal line 452 is connected to collector 433. A 5 V line 453 provides 5 V from I/O board 112 to inverter circuit 126. 5 V line 453 connects to inverter circuit 126 at a tap point 444 and to connector 400 at pin 3 shown at 403.

Figure 5:
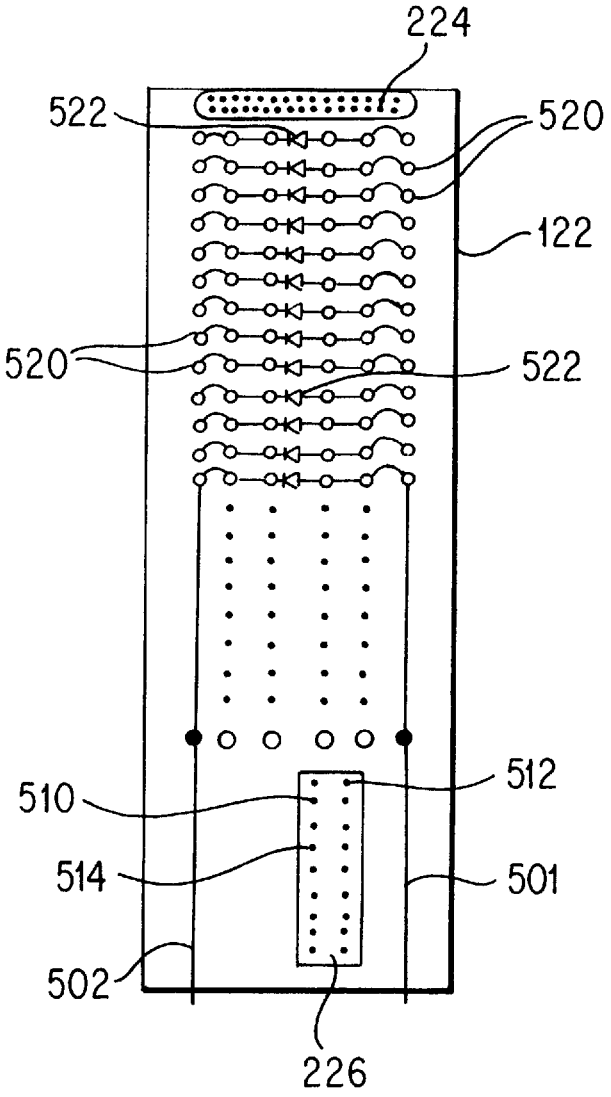
FIG. 5 shows further detail of a solenoid board shown in FIG. 1.

With reference now to FIG. 5, further detail is provided for solenoid board 122. FIG. 5 shows connector 224 that is used to connect solenoid board 122 to solenoid array 134 via ribbon cable 227. Connector 224 is connected to a series of solenoid connection blocks 520, one solenoid connection block 520 for each solenoid in solenoid array 134. Each solenoid connection block 520 includes a diode 522. Diode 522 is selected in accordance with the type of solenoid used in solenoid array 134, and can readily be done by one skilled in the relevant art.

A power supply line 501 provides 12 V to solenoid board 122 from power supply 124. Power supply line 501 is connected to output 451 of power supply 124 at pin 1 of connector 400 (shown at 401).

A control signal line 502 provides the signal to solenoid board 122 for controlling the actuation of the solenoids. Control signal line 502 is connected to control signal line 452 from inverter circuit 126 at pin 2 of connector 400 (shown at 402). In this manner, the control signal from I/O board 112 to actuate the solenoids is inverted by inverter circuit 126 before being sent to solenoid board 122.

Connector 226 provides a connection between solenoid board 122 and I/O board 112. Control signal 412 from I/O board 112 is connected to solenoid board 122 at pin 512. Ground 410 from I/O board 112 is connected to solenoid board 122 at pin 510. 5 V line 414 from I/O board 112 is connected to solenoid board 122 at pin 514.

It is to be understood that the above-described embodiment for solenoid board 122, power supply 124, and inverter circuit 126 is exemplary in nature. The present invention is not limited to this embodiment. The functions performed by solenoid board 122, power supply 124, and inverter circuit 126 can be implemented using other hardware components, or through a combination of software and hardware components.

The embodiment discussed above is configured so that solenoids 334 in solenoid array 134 are actuated substantially simultaneously as a group through one command received from computer controller 110. As such, fluid flows substantially simultaneously from each nozzle 332 in nozzle array 132. In an alternate embodiment shown in FIGS. 10 and 11, the automated dispensing system can be configured so that each solenoid is independently controlled on an individual basis. In this manner, the present invention can be used for selective delivery of fluid through the nozzles.

Figure 10:
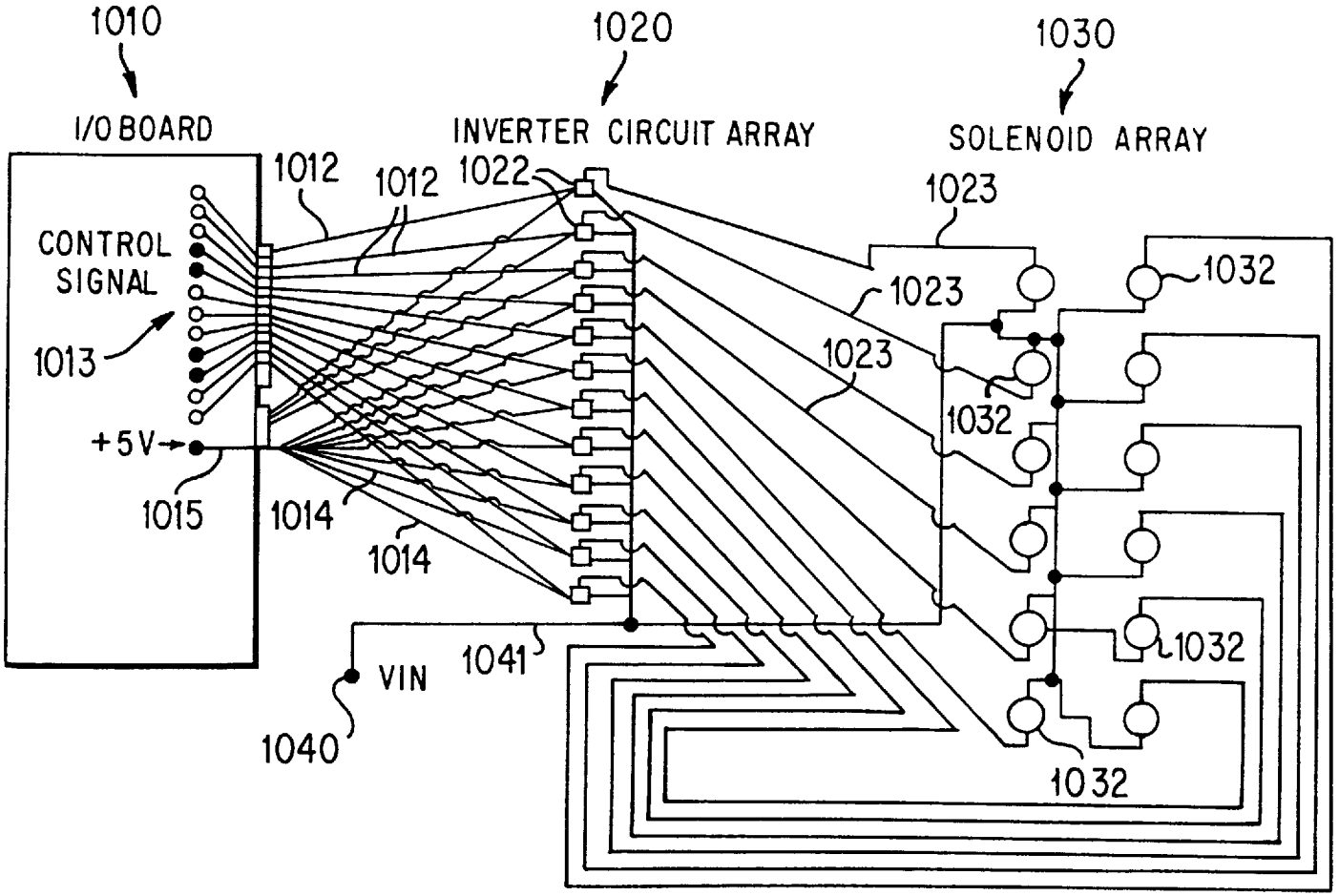
FIG. 10 shows a block diagram illustrating an alternate embodiment of the automated dispensing system of the present invention.

With reference now to FIG. 10, an I/O board 1010 is connected to an inverter circuit array 1020. I/O board 1010 provides signal input and output to a computer controller, such as computer controller 110 discussed above. A particularly preferred I/O board 1010 is the PCL-720 digital I/O and counter card available from ADVANTECH that was discussed above. The PCL-720 includes 32 addressable digital input channels, 32 addressable digital output channels, and 3 programmable counter/timer channels.

Twelve independently addressable digital output channels or ports of I/O board 1010, shown generally at 1013, are used to send a control signal to each inverter circuit 1022 in inverter circuit array 1020. Each inverter circuit 1022 is connected via a control signal line 1012 to one of the control signal ports 1013 of I/O board 1010. A shift register circuit can be used to shift the output control signal across each control signal port 1013. The shift register circuit can be located on I/O board 1010, or on a separate board. I/O board 1010 and the shift register circuit can be configured so that the output control signal is applied to each control signal port at the same time, or sequentially in time. A +5 V line 1015 on I/O board 1010 is connected to each inverter circuit 1022 via a 5 V line 1014.

Each inverter circuit 1022 is connected via a line 1023 to an individual solenoid 1032 in a solenoid array 1030. Each solenoid 1032 in solenoid array 1030 is connected via a line 1041 to a voltage source ($V_{in}$) 1040.

Inverter circuit 1022 operates in substantially the same manner as inverter circuit 126 described above. Inverter circuit 1022 is used to invert control signal 1012 from I/O board 1010 for actuating the solenoids. Control signal 1012 is a normally high control line. Control signal 1012 is inverted in inverter circuit 1022, and output to solenoid 1032 as a normally low signal on line 1023. When one of control signal ports 1013 receives a command from computer controller 110 to trigger the corresponding solenoid 1032 (thereby opening the normally closed valve of the corresponding nozzle), the control signal line 1012 for that control signal port 1013 goes low. Consequently, the output line 1023 of the corresponding inverter circuit 1022 goes high, thereby triggering the corresponding solenoid 1032.

Figure 11:
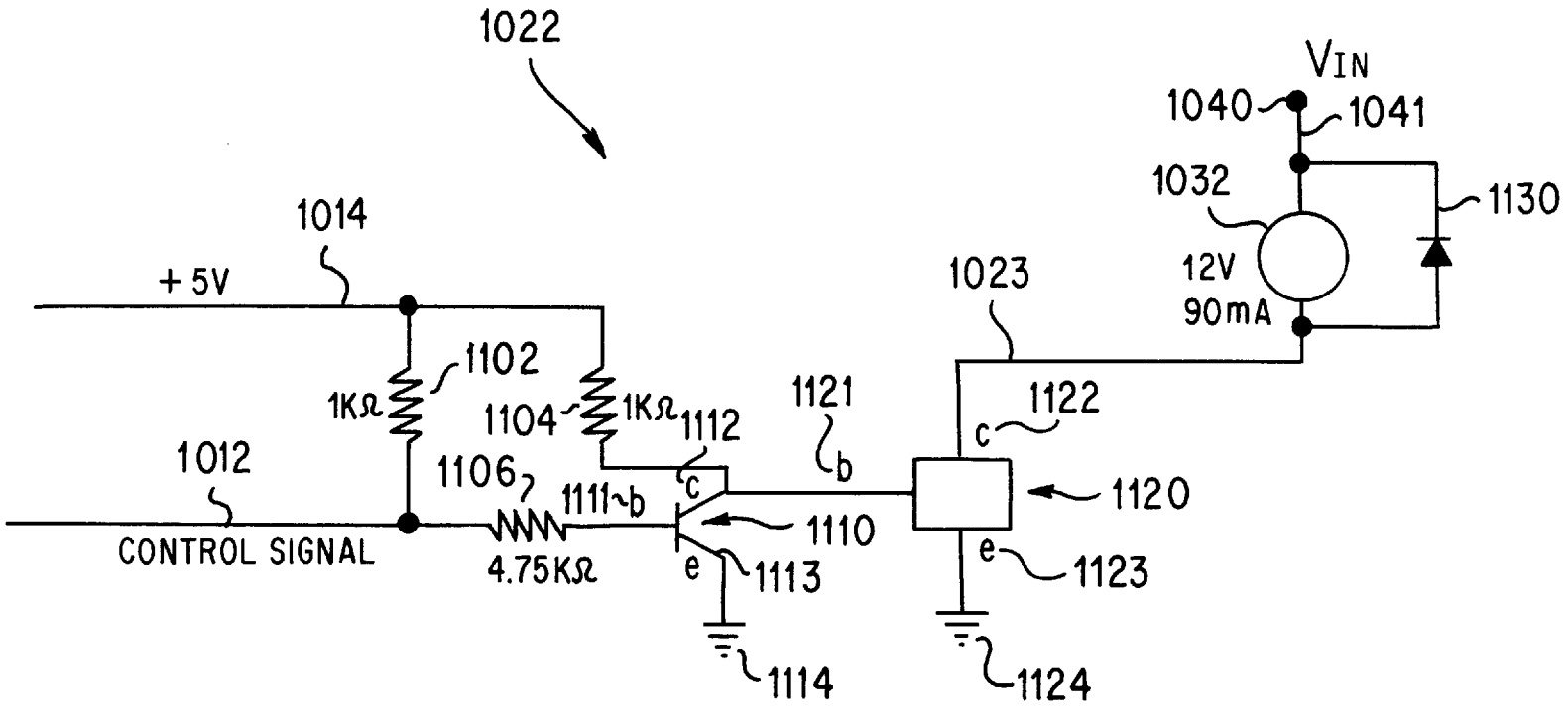
FIG. 11 shows one embodiment of a schematic for implementation of the alternate embodiment shown in FIG. 10.

A schematic for one embodiment of each inverter circuit 1022 is shown in FIG. 11. Inverter circuit 1022 includes a transistor 1110 that has an emitter 1113 connected to a ground 1114, a base 1111, and a collector 1112. Control signal 1012 is connected to base 1111 through a resistor 1106 (4.75 kOhm). 5 V line 1014 is connected to collector 1112 through a resistor 1104 (1 kOhm). A resistor 1102 (1 kOhm) is connected across 5 V line 1014 and control signal 1012.

Inverter circuit 1022 also includes a Darlington transistor 1120 that has an emitter 1123 connected to a ground 1124, a base 1121, and a collector 1122. Base 1121 is connected to collector 1112 of transistor 1110. Collector 1122 is connected to output line 1023 that goes to solenoid 1032. With the configuration shown in FIG. 11, solenoid 1032 is preferably a 12 V, 90 mA solenoid, but other solenoids can be used. Power is supplied to solenoid 1032 from voltage source ($V_{in}$) 1040 via line 1041. $V_{in}$ is preferably approximately 16 V. The connection to the solenoid includes a diode 1130. An IN4005 transistor can be used for diode 1130.

The embodiment shown in FIG. 10 includes twelve inverter circuits, one for each of the twelve solenoids of solenoid array 1030. It is to be understood that other numbers of solenoids and inverter circuits can be used, and the present invention is not limited to twelve as shown in FIG. 10.

The embodiment shown in FIGS. 10 and 11 can be used with computer controller 110, linear translation system 140, and dispenser assembly 230 described above. One of the advantages of the embodiment shown in FIGS. 10 and 11 is that it can be used with more than one type of fluid supply 238 to provide for selective delivery of fluids. For example, one or more of nozzles 332 can be connected via tubing 236 to a first fluid supply 238, one or more to a second fluid supply, one or more to a third fluid supply, etc. Each of the fluid supplies could be, for example, different reagents required in a chemical or biochemical process. Each fluid supply would be pressurized as needed to account for its volatility. In this manner, some of nozzles 332 would dispense a first reagent, some of nozzles 332 would dispense a second reagent, and some of nozzles 332 would dispense a third reagent, etc. Because the solenoids are independently controllable, the nozzles can be individually selectively opened so that some nozzles are dispensing while others are not.

Computer Program Implementation of the Preferred Embodiments

Figure 6:
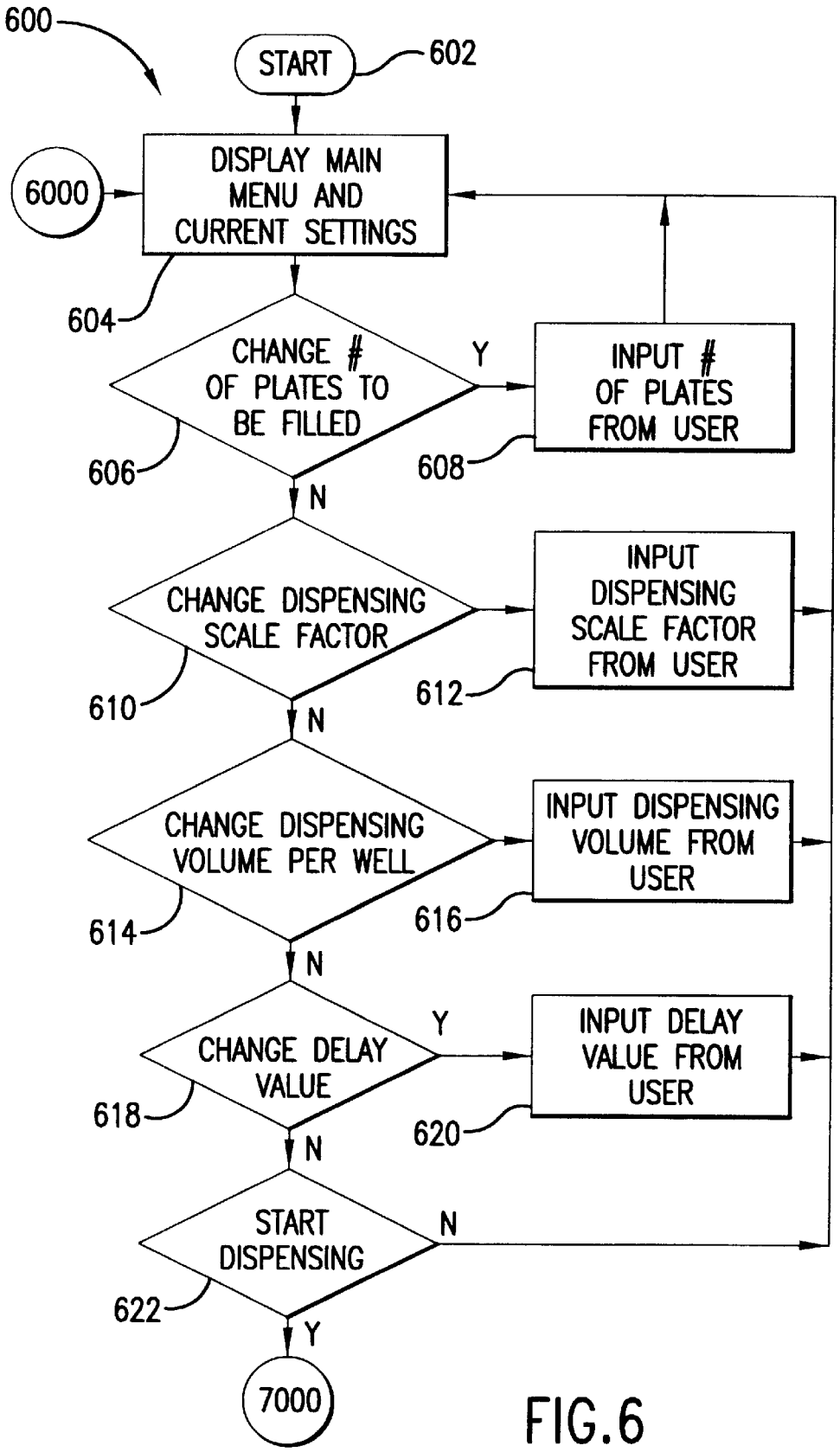
FIG. 6 shows a flow diagram illustrating one embodiment for implementation of the automated dispensing system of the present invention.

The present invention may be implemented using hardware, software, or a combination thereof, and may be implemented in a computer system or other processing system. A flowchart 600 for implementation of the present invention is shown in FIG. 6. Flowchart 600 begins with a start step 602. In a step 604, a main menu and current settings are displayed for a user. In one embodiment, the main menu allows a user to change the current settings or to begin a dispensing task. The current settings refer to a series of dispensing parameters used by the automated dispensing system of the present invention. In one embodiment of the present invention, the dispensing parameters include the following four parameters: (1) a number of plates or receptacles to be filled; (2) a dispensing scale factor; (3) a dispensing volume per receiving well; and (4) a delay value. The current settings for the dispensing parameters are displayed for the user. The user is prompted to retain the current settings of the dispensing parameters, or to input new settings for each of the dispensing parameters. In this manner, values for each of the dispensing parameters are determined for a particular dispensing task.

A first dispensing parameter is the number of plates or receptacles to be filled during the current dispensing task. In a preferred embodiment, this number ranges from one (1) to four (4), the capacity of microtiter plates that can be carried by platform 246. It is to be understood that the number of receptacles (first dispensing parameter) is not limited to the range of one to four, and can vary based upon the capacity of platform 246.

Figure 7:
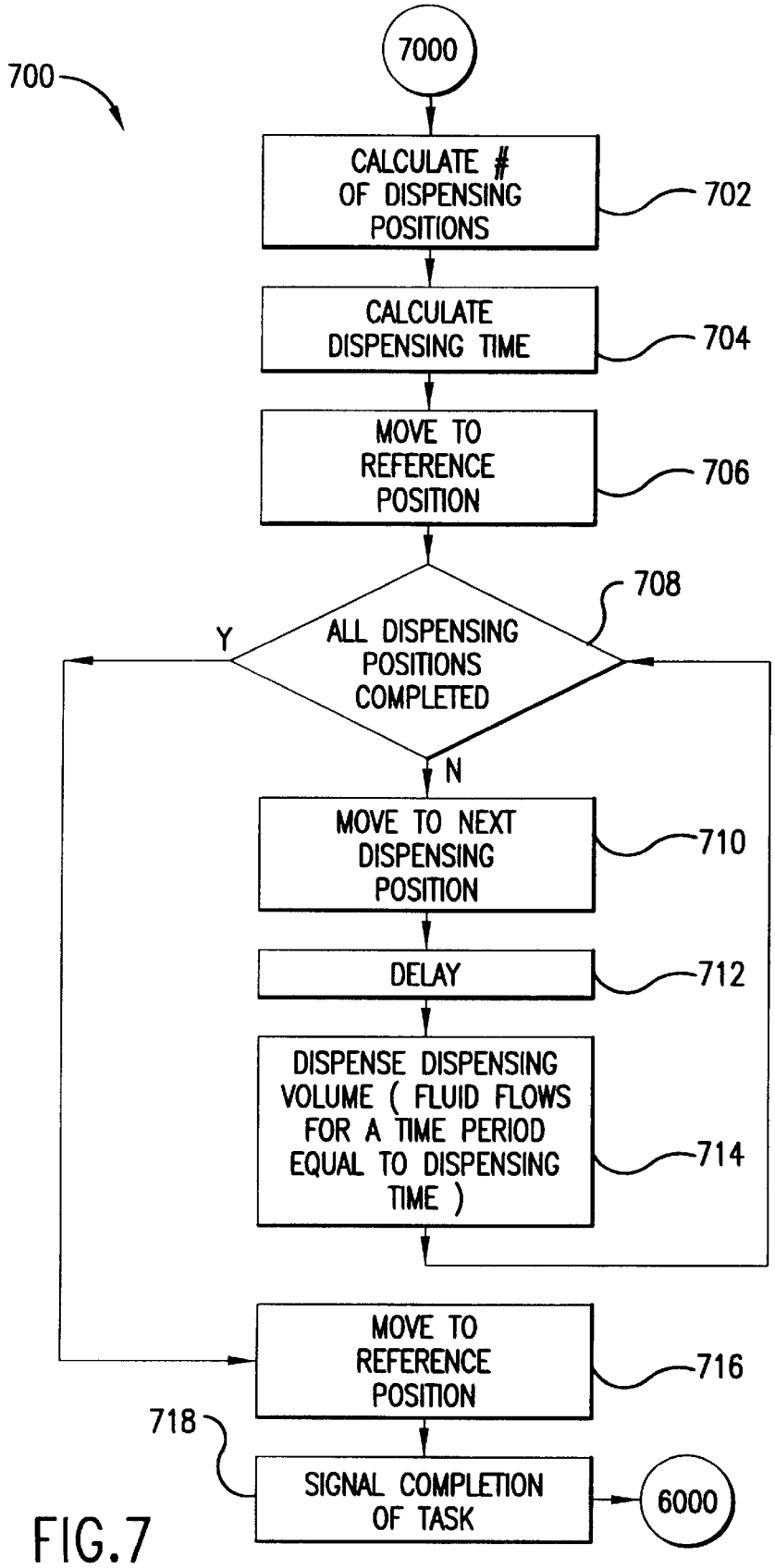
FIG. 7 shows a father flow diagram for implementation of the automated dispensing system of the present invention.

A second dispensing parameter is the dispensing scale factor. As used herein, dispensing scale factor refers to the time required to dispense a unit volume of the fluid to be dispensed. The dispensing scale factor is expressed as time per unit volume. In a preferred embodiment, the dispensing scale factor is expressed as millisecond (msec) per microliter ($\mu$l). The dispensing scale factor is a function of a physical property, viscosity, of the fluid to be dispensed. The dispensing scale factor can be readily determined empirically by one skilled in the relevant arts by measuring the amount of time required to dispense a unit volume of the fluid of interest from a nozzle such as nozzle 332. Fluids of different viscosities will typically have different dispensing scale factors. For example, $NH_4OH$ and water have different viscosities. Dispensing scale factors for NH OH and water were empirically determined using nozzles as described herein. The empirically determined dispensing scale factors are 2.5 msec/$\mu$l for an aqueous solution of 27% $NH_4OH$, and 2 msec/$\mu$l for water. $NH_4OH$ has about the same viscosity as water at room temperature (for example, 20° C.). However, $NH_4OH$ is very volatile at room temperature. Consequently, a pressurized supply of $NH_4OH$ is used so that the $NH_4OH$ is kept in solution. The dispensing scale factor ensures that the automated dispensing system of the present invention dispenses a calibrated quantity of fluid for fluids of varying viscosities. As explained more fully below with respect to step 704 in FIG. 7, through the use of the dispensing scale factor, fluids of different viscosities can be dispensed by controlling the dispensing time.

A third dispensing parameter is the dispensing volume. The dispensing volume refers to the volume to be dispensed into receiving wells 258 via nozzles 332. The dispensing volume is a function of the particular process or experiment in which the automated dispensing device is being used. For example, in the preferred embodiment, the automated dispensing device of the present invention is used to dispense ammonium hydroxide into 96-well microtiter plates for oligonucleotide cleavage. In such a process, the dispensing volume will preferably be 100 $\mu$l.

A fourth dispensing parameter is the delay value. The delay value is used to implement a delay between moving X-table 146 to a dispensing position, and beginning to dispense fluid. The delay accommodates a feedback loop between X-table 146 and servo controller 144 to verify that X-table 146 has moved to the correct position, and that the velocity of X-table 146 is zero. Using a 16 MHZ Compaq 386 desktop computer as computer controller 110, and the linear slide and servo controller available from IAI America Inc. noted above, a delay of 300 msec can be used. In an alternate embodiment of the present invention, the delay value dispensing parameter is not used. In such an alternate embodiment, the feedback from X-table 146 and servo controller 144 can be accommodated without a separate delay between moving the X-table to the dispensing position and beginning to dispense the fluid. The need for a delay value can readily be determined by one of skill in the relevant arts based upon the type of X-table 146, servo controller 144, and computer controller 110 that is used.

With reference now to FIG. 6, it is determined in a decision step 606 whether the number of plates or receptacles to be filled is to be changed. If the number of plates or receptacles to be filled is to be changed, then a new number of plates is input from a user in a step 608. Alternatively, a new number of plates can be input from a file that is stored in computer controller 110 or in another data storage device. In the embodiment illustrated in FIG. 6, each plate is assumed to be a 96-well microtiter plate, so that the only information needed is the number of plates. In an alternate embodiment, the user can be prompted for the number of well rows in each plate or receptacle to be filled in the current dispensing task. This will provide the total number of receptacles, as well as the total number of well rows to be filled. In such an alternate embodiment, the number of well rows can be the same or different in each receptacle to be filled. The number of well rows in each plate or receptacle to be filled in the current dispensing task can be input from a file that is stored in computer controller 110 or in another data storage device.

In a step 610, it is determined whether the dispensing scale factor is to be changed. If the dispensing scale factor is to be changed, then a new dispensing scale factor is input from the user in a step 612. Alternatively, a new dispensing scale factor can be input from a file that is stored in computer controller 110 or in another data storage device.

In a decision step 614, it is determined whether the dispensing volume per receiving well is to be changed. If the dispensing volume is to be changed, then a new dispensing volume is input from the user in a step 616. Alternatively, a new dispensing volume can be input from a file that is stored in computer controller 110 or in another data storage device. For example, a file can be used that includes a dispensing volume for each dispensing position. In such a file, the dispensing volume can be the same or different at each dispensing position.

In a decision step 618, it is determined whether the delay value is to be changed. If the delay value is to be changed, a new delay value is input from the user in a step 620. Alternatively, a new delay value can be input from a file that is stored in computer controller 110 or in another data storage device.

In a decision step 622, the user is prompted for whether the current dispensing task should begin. If the dispensing task should begin, processing continues in a flowchart 700 shown in FIG. 7 by way of flowchart connector 7000. If the dispensing task is not to begin, then processing returns to step 604 where the main menu and current settings of the dispensing parameters are displayed for the user.

Flowchart 700 begins with a step 702 to calculate a number of dispensing positions. The number of dispensing positions is a function of the number of receptacles 250, and the number of well rows 252 per receptacle. For example, the number of dispensing positions can be calculated by determining the number of receptacles that are on platform 246 of X-table 146, and by determining the number of well rows per receptacle. The number of plates to be filled is determined in step 606, either the current setting of this dispensing parameter is used, or a new value is input from the user or from a data storage device. When receptacle 250 is a microtiter plate, each receptacle will have eight well rows. The number of dispensing position can be obtained by multiplying the number of receptacles by the number of well rows (8), to determine the number of dispensing positions. As explained above with reference to step 606, in an alternate embodiment, a user can be prompted to enter the number of well rows for each receptacle to be filled. In such an alternate embodiment, the number of dispensing positions can be obtained by summing the number of well rows for each receptacle to obtain a total number of well rows, each well row corresponding to a dispensing position.

In a step 704, the dispensing time is calculated. In the preferred embodiment of the present invention, the dispensing time is the time in msec that solenoid array 134 opens the solenoid actuated valves to allow fluid to flow through nozzle array 132. The dispensing time can be calculated by multiplying the dispensing volume by the dispensing scale factor. For example, the present invention can be used to dispense $NH_4OH$ into microtiter plates for oligonucleotide cleavage. In such an embodiment, the dispensing scale factor is preferably 2.5 msec/μl and the dispensing volume is preferably 100 μl. The dispensing time for such an embodiment would therefore be 250 msec computed as follows:

$$2.5\ \text{msec}/\mu\text{l} \times 100\ \mu\text{l} = 250\ \text{msec}$$

Through the use of the dispensing scale factor, fluids of different viscosities can be dispensed by controlling the dispensing time. This provides an accurate means for dispensing a calibrated quantity of fluid. The dispensing time can be precisely controlled, so that the quantity of fluid dispensed is accurate and repeatable. The dispensing scale factor ensures that the quantity of fluid dispensed during the dispensing time is accurate by compensating for the different viscosities and flow rates of varying fluids.

In a step 706, X-table 146 carrying the receptacles to be filled is moved to a reference position. Step 706 is carried out by sending a command from computer controller 110 via connection 243 to I/O adapter 242. This command is translated or converted to a servo controller command that is sent via connection 245 to servo controller 144. Servo controller 144 commands X-table 146 to move via signals carried on connection 247.

In a preferred embodiment of the present invention, servo controller 144 contains a data storage device or memory device such as an EEPROM in which is stored a dispensing position table. Each entry in the dispensing position table includes a dispensing position number, a velocity, and a location of the dispensing position. In the preferred embodiment of the present invention, the dispensing position table is configured to represent four 96-well standard microtiter plates with 9 mm well row spacing. In such an embodiment, dispensing position table includes 32 (4 plates, 8 well rows per plate) dispensing position entries, and a reference position entry. The locations for dispensing position entries 1–8, 9–16, 17–24, and 25–32 will be spaced apart by approximately 9 mm to correspond to the 9 mm row spacing in a standard 96-well microtiter plate. The locations for dispensing position entries 8 and 9, 16 and 17, and 24 and 25 are spaced apart by an amount greater than 9 mm (approximately 25–30 mm) to accommodate the separation between microtiter plates. The velocity for dispensing position entries 1–32 and the reference position entry is preferably 100 mm/sec. This represents the velocity at which the X-table is moved to the location corresponding to that dispensing position entry. Alternatively, the X-table can be moved a specified distance from a reference position, rather than to a particular location in a dispensing position table.

It would be readily apparent to one of skill in the relevant arts how to configure computer controller 110, I/O adapter 142, and servo controller 144 to carry out the functions described above for moving the X-table. One of skill in the relevant arts could readily use the servo controller and I/O adapter described above that is available from IAI America, Inc. to implement the functions for moving the X-table.

In a decision step 708, it is determined whether all dispensing positions are completed, i.e., whether the dispensing volume has been dispensed into all well rows of the receptacles to be filled by the current dispensing task. If all dispensing positions are completed, then processing continues at a step 716 in which X-table 146 is moved to the reference position. Step 716 can be carried out in the manner described above with respect to step 706. The completion of the dispensing task is signaled to the user or operator in a step 718. Processing then continues at step 604 of flowchart 600 by way of flowchart connector 6000.

If in decision step 708 it is determined that all dispensing positions are not completed, then processing continues to a step 710. In step 710, X-table 146 is moved to the next dispensing position. In one embodiment, X-table 146 is moved to the location corresponding to the next dispensing position entry in the dispensing position table. For example, X-table 146 is moved from one well row in one of the receptacles shown in FIG. 2 to the next well row. The next well row may be in the same receptacle, or in another receptacle.

In a step 712, a delay is implemented between moving to the next dispensing position in step 710, and dispensing the dispensing volume in a step 714. The delay is for a time period equal to the delay value dispensing parameter. Delay step 712 is optional, and the present invention can be implemented without delay step 712.

In step 714, the dispensing volume is dispensed. In step 714, fluid is caused to flow for a time period equal to the dispensing time. This is carried out by actuating solenoid array 134 to allow fluid to flow from nozzle array 132. The solenoid actuated valves remain open for a time period equal to the dispensing time. In this manner, a calibrated quantity of fluid is dispensed substantially simultaneously into the receiving wells of each well row of the receptacles. In a preferred embodiment, the dispensing volume dispensed at each dispensing position is the same. For example, the same volume of $NH_4OH$ can be dispensed to each well row in the 96-well microtiter plate. In an alternate embodiment, the dispensing volume at each dispensing position can be different.

After step 714, processing returns to decision step 708 to determine if all dispensing positions have been completed. In an alternate embodiment, a delay step similar to that shown at step 712 can be inserted between step 714 (dispensing) and step 708. This would provide a delay between the dispensing step and moving X-table 146 to the next dispensing position. Such a delay could be used to ensure complete delivery of the dispensing volume.

In an alternate embodiment of the present invention, the automated dispensing system is implemented to provide independent control of the solenoids for selective delivery of fluid through the nozzles. Such an embodiment was described above with respect to FIGS. 10 and 11. To implement such an embodiment, computer controller 110 is configured to address each control signal port 1013 on I/O board 1010 to control the dispensing of fluid through the associated nozzles. In one embodiment, a data file is used to specify how fluid should be dispensed through each nozzle in a nozzle array. As explained below, each record in the data file preferably includes a receiving well ID, a receiving well ID dispensing position, and a nozzle ID. The data file preferably includes a record for each of the receiving wells in the receptacles being filled.

The receiving well ID (receiving well identifier) corresponds to one receiving well in the array being used. For example, the receiving wells on a 96-well microtiter plate can each be given a unique alphanumeric identifier using letters A through H and numerals 1 through 12 to correspond to an 8 (row)×12 (column) array as follows.

| | | Row | | | | | | | |
|---|---|---|---|---|---|---|---|---|---|
| | | A | B | C | D | E | F | G | H |
| | 1 | A1 | | | | | | | |
| | 2 | | | | | | | | |
| | 3 | | | | | | | | |
| | 4 | | B4 | | | | | | |
| | 5 | | | . | | | | | |
| Column | | | | | | | | | |
| | 6 | | | | . | | | | |
| | 7 | | | | | . | | | |
| | 8 | | | | | | | | |
| | 10 | | | | | | . | | |
| | 11 | | | | | | | | |
| | 12 | . | . | . | . | . | . | . | H12 |

In this manner, the receiving well in the second row, fourth column would have a receiving well ID of B4.

Another entry in the record is the receiving well ID dispensing position. This value enables the location of the dispensing position for the receiving well with the receiving well ID specified in that record to be retrieved from the dispensing position table stored in servo controller 144. The nozzle ID identifies which nozzle will be used to dispense into the receiving well with the receiving well ID specified in that record in the data file. The nozzle ID can also serve to identify which control signal port 1013 will be accessed for dispensing in accordance with the information contained in that record in the data file.

Each record in the data file can also include a dispense flag. If the dispense flag is set to zero, then no fluid is dispensed into the receiving well with the receiving well ID specified in that record in the data file. If the dispense flag is set to one, then fluid is dispensed in accordance with the other information in that record in the data file.

Each record in the data file can also include a dispensing volume that indicates the volume to be dispensed into the receiving well specified by the receiving well ID in that record. Each record can also include a dispensing scale factor to be used in calculating the dispensing time in the manner discussed above for the dispensing volume specified in that record. Alternatively, the dispensing volume and dispensing scale factor to be used can be input from a user in the manner discussed above.

Each record in the data file can also include a fluid supply designator that designates the fluid supply from which the dispensing volume is to be obtained. In this manner, each nozzle can be configured to dispense fluid from more than one fluid supply.

The automated dispensing system of the present invention uses the information in the data file to dispense fluid in a manner similar to that described above with respect to FIG. 7. The records in the data file (one for each receiving well ID) are used to calculate the number of dispensing positions. The dispensing time is calculated for each record (each receiving well ID). The location of the dispensing position for each receiving well ID is accessed using the receiving well ID dispensing position in each record. X-table 146 carrying the receptacles to be filled is moved to each dispensing position in the manner described above until all dispensing positions have been completed.

Figure 8:
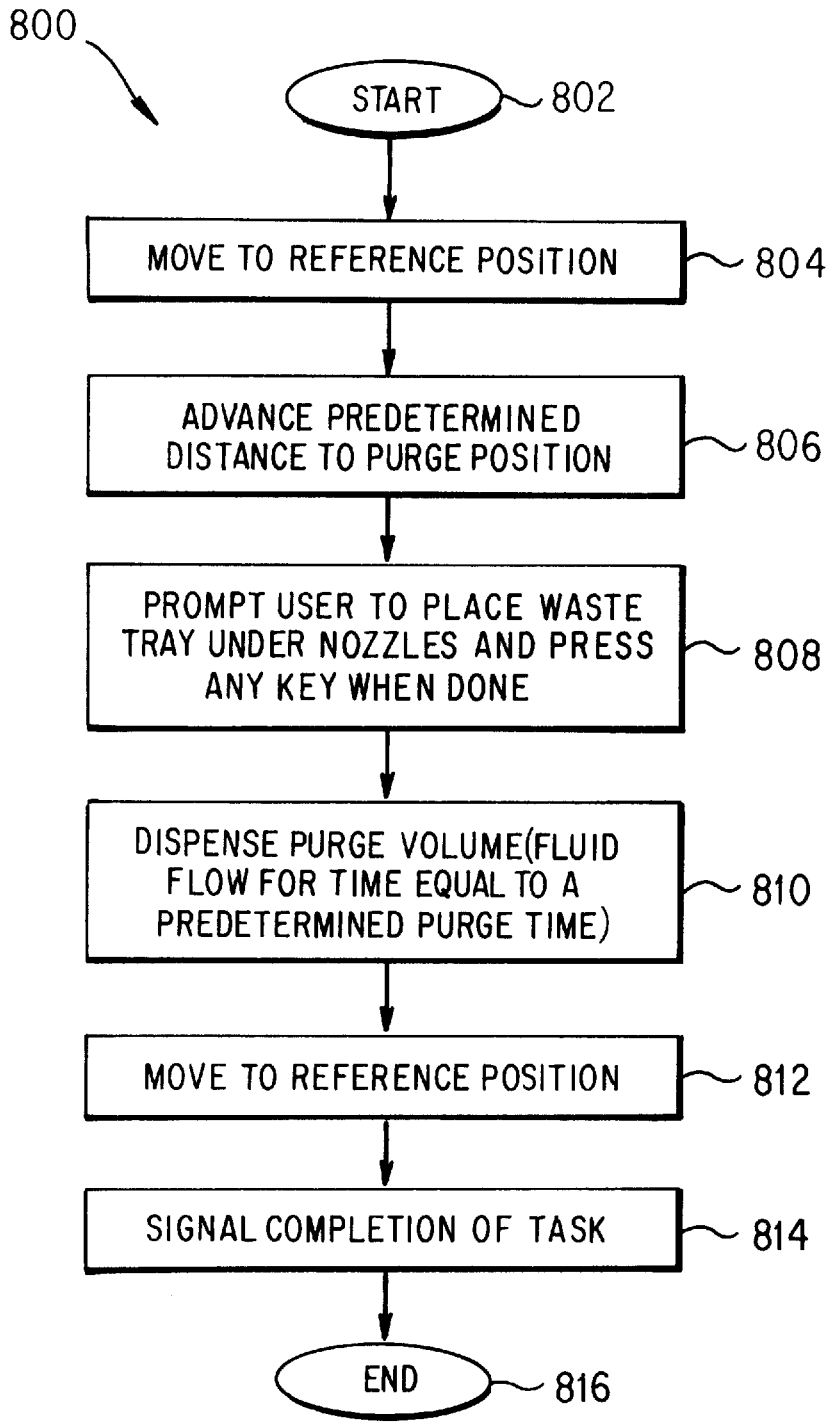
FIG. 8 shows a flow diagram that illustrates a method for purging the automated dispensing system of the present invention.

FIG. 8 shows a flowchart 800 that illustrates a method for purging the automated dispensing system of the present invention. Purging would be carried out, for example, when fluid supply 238 is changed, such as to provide a new bottle of $NH_4OH$. Flowchart 800 begins with a start step 802. In a step 804, X-table 146 is moved to a reference position. This can be carried out in a manner similar to that described above for steps 706 and 716.

In a step 806, X-table 146 is advanced a predetermined distance to a purge position. In a preferred embodiment, the predetermined distance is 100 mm from the reference position. X-table 146 is preferably moved the predetermined distance 100 mm at a speed of 50 mm/sec. This can be carried out in a manner similar to that described above for steps 706 and 716.

In a step 808, the user is prompted to place a waste tray under nozzle array 132, and to press any key when done. Responsive to the press of any key by a user, a purge volume is dispensed in a step 810. Fluid flows for a time equal to a predetermined purge time. This is carried out by actuating solenoid array 134 to allow fluid to flow through nozzle array 132 in a manner similar to that previously described. In a preferred embodiment, the purge time is preferably 1.5 seconds.

In a step 812, X-table 146 is moved to the reference position in a manner similar to that previously described. In a step 814, completion of the purging task is signaled to a user. Flowchart 800 ends in a step 816.

Figure 9:
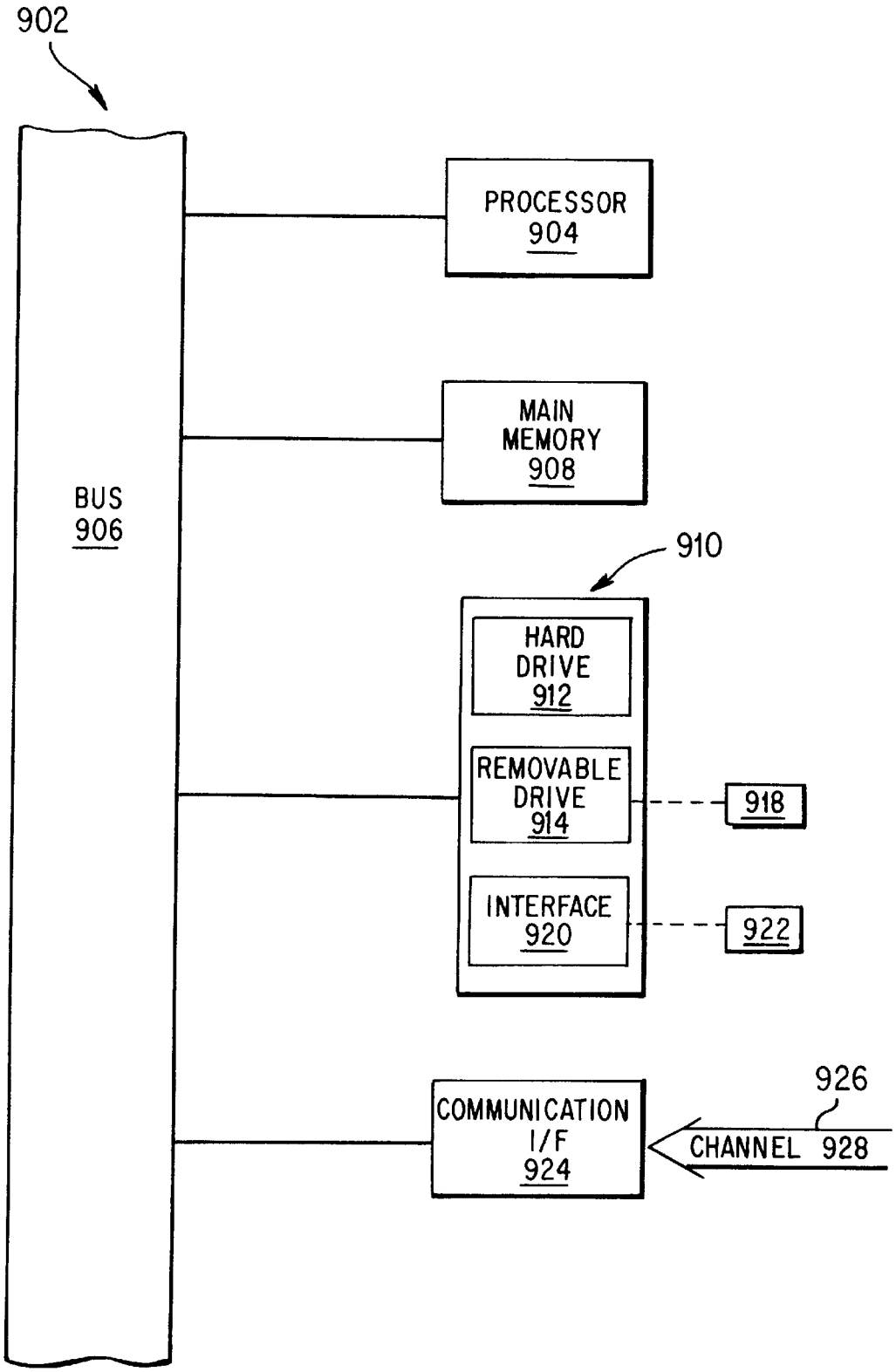
FIG. 9 shows an exemplary computer system suitable for use with the present invention.

As stated above, the invention may be implemented using hardware, software, or a combination thereof, and may be implemented in a computer system or other processing system, such as computer controller 110. In one embodiment, the invention is directed toward a computer system capable of carrying out the functionality described herein. An exemplary computer system 902 is shown in FIG. 9. Computer system 902 includes one or more processors, such as processor 904. Processor 904 is connected to a communication bus 906. Various software embodiments are described in terms of this exemplary computer system. After reading this description, it will become apparent to a person skilled in the relevant art how to implement the invention using other computer systems and/or computer architectures.

Computer system 902 also includes a main memory 908, preferably random access memory (RAM), and can also include a secondary memory 910. Secondary memory 910 can include, for example, a hard disk drive 912 and/or a removable storage drive 914, representing a floppy disk drive, a magnetic tape drive, an optical disk drive, etc. Removable storage drive 914 reads from and/or writes to a removable storage unit 918 in a well known manner. Removable storage unit 918, represents a floppy disk, magnetic tape, optical disk, etc. which is read by and written to by removable storage drive 914. As will be appreciated, removable storage unit 918 includes a computer usable storage medium having stored thereon computer software and/or data.

In alternative embodiments, secondary memory 910 may include other similar means for allowing computer programs or other instructions to be loaded into computer system 902. Such means can include, for example, a removable storage unit 922 and an interface 920. Examples of such can include a program cartridge and cartridge interface (such as that found in video game devices), a removable memory chip (such as an EPROM, or PROM) and associated socket, and other removable storage units 922 and interfaces 920 which allow software and data to be transferred from removable storage unit 922 to computer system 902.

Computer system 902 can also include a communications interface 924, such as I/O board 112. Communications interface 924 allows software, data, and other digital information or analog signals to be transferred between computer system 902 and external devices. Examples of communications interface 924 can include a modem, a network interface (such as an Ethernet card), a communications port, a PCMCIA slot and card, etc. Software and data transferred via communications interface 924 are in the form of signals which can be electronic, electromagnetic, optical or other signals capable of being received by communications interface 924. Such signals 926 are provided to communications interface via a channel 928. Channel 928 carries signals 926 and can be implemented using wire or cable, fiber optics, a phone line, a cellular phone link, an RF link and other communications channels. Channel 928 can be used to implement connections 243 between computer controller 110 and I/O adapter 142 (see FIG. 2). Channel 928 can also be used to implement connection 241 between computer controller 110 and power supply and junction box 120.

In this document, the terms "computer program medium" and "computer usable medium" are used to generally refer to media such as removable storage device 918, a hard disk installed in hard disk drive 912, and signals 926. These computer program products are means for providing software to computer system 902.

Computer programs (also called computer control logic) are stored in main memory and/or secondary memory 910. Computer programs can also be received via communications interface 924. Such computer programs, when executed, enable computer system 902 to perform the features of the present invention as discussed herein. In particular, the computer programs, when executed, enable processor 904 to perform the features of the present invention. Accordingly, such computer programs represent controllers of computer system 902.

In an embodiment where the invention is implemented using software, the software may be stored in a computer program product and loaded into computer system 902 using removable storage drive 914, hard drive 912, interface 920, or communications interface 924. The control logic (software), when executed by processor 904, causes processor 904 to perform the functions of the invention as described herein.

In a preferred embodiment of the present invention, a Compaq 386 computer (16 MHZ) controlled by software written in the BASIC programming language is used to implement the present invention. It is to be understood that other types of computer systems or controllers, and other types of programming languages can be used. Based on the disclosure provided herein, a computer programmer skilled in the relevant art could readily implement the present invention using software and hardware.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An apparatus for dispensing a calibrated quantity of a fluid into at least one receptacle, the at least one receptacle having an array of spaced-apart receiving wells arranged in at least one well row, the apparatus comprising:

an array of nozzles through which the fluid flows into the receiving wells, wherein nozzles in said array of nozzles are spaced-apart by a distance substantially similar to a spacing between receiving wells in the at least one well row for alignment between said array of nozzles and the receiving wells in the at least one well row;

relative movement means for providing relative movement between the at least one receptacle and said array of nozzles, wherein said relative movement means provides movement to a dispensing position wherein the at least one well row is aligned with said array of nozzles;

dispensing control means operatively coupled to said array of nozzles for dispensing a dispensing volume into the receiving wells, wherein said dispensing control means causes fluid to flow from each nozzle in said array of nozzles into the receiving wells of the at least one well row for a time period equal to a dispensing time, wherein said dispensing control means determines said dispensing time from said dispensing volume and a dispensing scale factor, wherein said dispensing scale factor is the time required to dispense a unit volume of the fluid.

2. The apparatus of claim 1, further comprising:

moving control means, operatively coupled to said relative movement means and to said dispensing control means, for controlling movement of said relative movement means.

3. The apparatus of claim 2, wherein said moving control means comprises a servo controller.

4. The apparatus of claim 2, wherein said dispensing control means comprises dispensing position means for determining a number of dispensing positions required to dispense said dispensing volume into each of the receiving wells in the array and for determining a location for each of said number of dispensing positions.

5. The apparatus of claim 4, wherein said dispensing control means causes said moving control means to sequentially move said relative movement means to said location for each of said number of dispensing positions.

6. The apparatus of claim 1, further comprising:

nozzle control means operatively coupled to said dispensing control means for controlling flow of the fluid through said array of nozzles.

7. The apparatus of claim 6, wherein said nozzle control means comprises a solenoid operated valve.

8. The apparatus of claim 6, wherein said nozzle control means comprises:

an array of solenoid operated valves, wherein each valve in said array of solenoid operated valves corresponds to a nozzle in said array of nozzles.

9. The apparatus of claim 1, wherein said dispensing control means comprises dispensing position means for determining a number of dispensing positions required to dispense said dispensing volume into each of the receiving wells in the array.

10. The apparatus of claim 9, wherein said dispensing position means further comprises means for determining a location for each of said number of dispensing positions.

11. The apparatus of claim 1, wherein each of said array of nozzles is independently controllable by said dispensing control means.

12. The apparatus of claim 1, further comprising:

pressurizing means for pressurizing the fluid.

13. The apparatus of claim 1, wherein said dispensing control means causes fluid to flow substantially simultaneously from each nozzle in said array of nozzles.

14. The apparatus of claim 1, wherein said relative movement means comprises a movable platform configured to carry the at least one receptacle.

15. A method for dispensing a calibrated quantity of a fluid into one or more receptacles, each receptacle having an array of spaced-apart receiving wells arranged in a plurality of spaced-apart well rows, the method comprising:

(1) determining a number of dispensing positions, wherein each dispensing position corresponds to a corresponding well row in the array;

(2) determining a dispensing volume to be dispensed at each dispensing position;

(3) determining a dispensing scale factor, wherein the dispensing scale factor is the time required to dispense a unit volume of the fluid;

(4) determining a dispensing time from the dispensing volume and the dispensing scale factor; and (5) for each of the number of dispensing positions, allowing the fluid to flow into the receiving wells of the corresponding well row for a time period equal to the dispensing time.

16. The method of claim 15, wherein step (5) comprises:

(a) sequentially moving the array to each of the number of dispensing positions so that the corresponding well row is aligned with an array of nozzles for dispensing the dispensing volume into the receiving wells of the corresponding well row.

17. The method of claim 16, wherein step (5) further comprises:

(b) determining a location for each of the number of dispensing positions.

18. The method of claim 17, wherein step (5)(b) comprises:

(1) retrieving the location for each of the number of dispensing positions from a memory.

19. The method of claim 15, wherein step (1) comprises:

(a) determining a number of receptacles;

(b) determining a number of well rows; and (c) multiplying the number of receptacles by the number of well rows to determine the number of dispensing positions.

20. The method of claim 15, wherein step (4) comprises:

(a) multiplying the dispensing volume by the dispensing scale factor to determine the dispensing time.

21. The method of claim 15, wherein the dispensing volume for each dispensing position is the same.

22. A computer program product comprising a computer useable medium having computer program logic recorded thereon for enabling a processor in a computer system to dispense a calibrated quantity of a fluid into one or more receptacles, each receptacle having an array of spaced-apart receiving wells arranged in a plurality of spaced-apart well rows, said computer program logic comprising:

dispensing position number determining means for enabling the processor to determine a number of dispensing positions, wherein each dispensing position corresponds to a corresponding well row in the array;

dispensing volume determining means for enabling the processor to determine a dispensing volume to be dispensed at each dispensing position;

dispensing scale factor determining means for enabling the processor to determine a dispensing scale factor, wherein the dispensing scale factor is the time required to dispense a unit volume of the fluid;

dispensing time determining means for enabling the processor to determine a dispensing time from the dispensing volume and the dispensing scale factor; and fluid control means for enabling the processor to allow, for each of the number of dispensing positions, the fluid to flow into the receiving wells of the corresponding well row for a time period equal to the dispensing time.

23. The computer program product of claim 22, wherein said fluid control means comprises:

moving means for enabling the processor to sequentially move the array to each of the number of dispensing positions so that the corresponding well row is aligned with an array of nozzles for dispensing the dispensing volume into the receiving wells of the corresponding well row.

24. The computer program product of claim 23, wherein said moving means comprises:

location determining means for enabling the processor to determine a location for each of the number of dispensing positions.

25. The computer program product of claim 22, wherein the dispensing volume for each dispensing position is the same.

26. An apparatus for selectively dispensing fluid into a receptacle having an array of spaced-apart receiving wells, the apparatus comprising:

an array of nozzles through which the fluid flows into the receiving wells; and dispensing control means operatively coupled to said array of nozzles to independently control dispensing by each of said nozzles in said array of nozzles, wherein said dispensing control means dispenses a dispensing volume from one of said nozzles by causing fluid to flow from said one nozzle for a time period equal to a dispensing time, wherein said dispensing control means determines said dispensing time from said dispensing volume and a dispensing scale factor, wherein said dispensing scale factor is the time required to dispense a unit volume of the fluid.

27. The apparatus of claim 26, wherein said dispensing control means comprises determining means for determining a receiving well identifier that identifies each of said spaced-apart receiving wells to receive fluid, for determining a dispensing position location for each receiving well identifier, and for determining a nozzle identifier that identifies one of said nozzles for each receiving well identifier.

28. The apparatus of claim 27, further comprising:

relative movement means for providing relative movement between the receptacle and said array of nozzles, wherein said relative movement means provides movement to each of said dispensing position locations; and moving control means, operatively coupled to said relative movement means and to said dispensing control means, for controlling movement of said relative movement means.

29. The apparatus of claim 28, wherein said relative movement means comprises a movable platform configured to carry the receptacle.

30. The apparatus of claim 27, wherein said dispensing control means further comprises determining means for determining a dispensing volume for each receiving well identifier.

31. The apparatus of claim 26, wherein at least one of said nozzles is configured to receive fluid from a first fluid supply and at least one of said nozzles is configured to receive fluid from a second fluid supply different from said first fluid supply.

32. The apparatus of claim 26, wherein said dispensing control means dispenses said dispensing volume substantially simultaneously from each of said nozzles in said array of nozzles.

* * * * *